United States Patent [19]
Maaghul
[11] 4,298,653
[45] Nov. 3, 1981

[54] METHOD FOR PRODUCING AN IMPROVED BUNDLE OF A PLURALITY OF FIBER GLASS STRANDS

[75] Inventor: John Maaghul, Monroeville, Pa.
[73] Assignee: PPG Industries, Inc., Pittsburgh, Pa.

[21] Appl. No.: 114,532
[22] Filed: Jan. 23, 1980

Related U.S. Application Data

[63] Continuation of Ser. No. 969,898, Dec. 15, 1978, abandoned.

[51] Int. Cl.[3] ..... D02G 3/00
[52] U.S. Cl. ..... 428/378; 156/166; 156/169; 156/180; 156/272; 156/283; 156/296; 428/364; 428/392
[58] Field of Search ..... 156/166, 167, 169, 172, 156/180, 283, 290, 291, 296, 344, 272, 305, 306, 441; 428/375, 378, 392, 364, 373, 198

[56] References Cited

U.S. PATENT DOCUMENTS

| | | | |
|---|---|---|---|
| 2,395,157 | 2/1946 | Work et al. | 427/185 |
| 2,730,455 | 1/1956 | Swann | 427/13 |
| 2,778,764 | 1/1957 | Morrison | 428/378 |
| 3,158,519 | 11/1964 | Shannon et al. | 156/296 X |
| 3,168,389 | 2/1965 | Eilerman | 428/378 |
| 3,220,905 | 11/1965 | Doob, Jr. et al. | 156/296 X |
| 3,425,862 | 2/1969 | Eakins | 428/392 X |
| 3,586,560 | 6/1971 | Stranch et al. | 156/180 X |
| 3,673,027 | 6/1972 | Spencer | 428/392 X |
| 3,686,048 | 8/1972 | Schirtzinger | 156/296 X |
| 3,742,106 | 6/1973 | Price | 264/131 |
| 3,817,211 | 6/1974 | Brown . | |
| 3,862,287 | 1/1975 | Davis | 264/131 |
| 3,919,437 | 11/1975 | Brown et al. | 427/13 |
| 3,948,673 | 4/1976 | Chase et al. | 428/378 |
| 4,049,865 | 9/1977 | Maaghul | 428/392 |

*Primary Examiner*—Lorraine T. Kendell
*Attorney, Agent, or Firm*—Kenneth J. Stachel

[57] ABSTRACT

A method is provided giving a bundle of glass fiber strands improved integrity. A plurality of glass fiber strands are contacted with a fine, particlized, thermoplastic material in an amount up to about 0.5% by weight of the dried combined plurality of glass fiber strands in a forced gas chamber. The plurality of glass fiber strands containing the thermoplastic material is heated so that the thermoplastic material is softened on the plurality of strands thereby holding the strands together in such a manner that the plurality of strands can be processed without separating, but when the plurality of strands are chopped or woven the strands separate.

12 Claims, 3 Drawing Figures

METHOD FOR PRODUCING AN IMPROVED BUNDLE OF A PLURALITY OF FIBER GLASS STRANDS

This is a continuation of application Ser. No. 969,898, filed Dec. 15, 1978, now abandoned.

BACKGROUND OF THE INVENTION

This invention relates to a method for producing a plurality of fiber glass strands into an improved bundle of strands. More particularly, this invention relates to a method for producing an improved fiber glass roving.

In conventional production of glass fibers, the glass fibers are made from a multitude of fine glass filaments, which are formed by being drawn at a high rate of speed from molten glass streams flowing from small openings in a bushing, which contains molten glass. Since glass fibers easily abrade each other, a chemical size is applied to the filaments to protect the filaments when they are gathered together into a strand, and when the strand is subjected to further processing. The chemical size gives the filaments integrity and workability for any standard textile or reinforcement use. After the glass filaments are formed and coated with the chemical size, they are drawn together by a gathering shoe into one or more glass fiber strands. The drawing of the filaments from the bushing is effected by the use of a winder is also used to wrap to wrap the strand on a tube or spool to produce a forming package. The glass fiber strand is removed from the forming package to produce the main fiber glass products such as mats, rovings, woven rovings, (also called roving cloth), chopped and milled fibers, and yarns.

Rovings have been defined as cylindrically shaped packages of bundles of glass fiber strands wound up in parallel without a twist. Rovings are made placing a number of forming packages on a creel and collecting the strands together and passing them through guide eyes and tensioning devices and then winding the strands together as one bundle of strands onto a winding machine that is standard in the industry.

In the conventional production of glass filaments or fibers into bundles or strands to be processed into roving, it is customary to use only the size or binder material which is placed on the filaments as they are formed under the bushing and gathered into strand. The size or binder material on the strand provides some degree of integrity or bonding for the filaments when the strands are gathered in the roving process. Rovings produced in this manner are referred to as dry rovings.

Glass fiber rovings are further processed by chopping or weaving the rovings for use in many different applications. When the rovings are chopped, the chopped glass fibers are combined with resin or binders for lay up methods of molding or to form preforms or for the manufacture of sheeting. When the rovings are woven, they are used as reinforcing materials for resins such as polyesters or epoxides. Rovings have also been used for winding and rod making, for example, in the manufacture of pipe and cylindrical tanks.

When rovings are chopped, the glass fiber strands in the roving must have good choppability, which is controlled by such factors as the diameter of the strand, the fiber size used during formation of the strand, the drying time of the forming package and the effect of additives in the sizing composition. Good chopping characteristics of the strand include good integration of the filaments in the strand so they do not readily filamentise, and therefore, slip easily over one another as they hit a surface after chopping. The preservation of strand integrity during chopping is important as this facilitates the removal of air during molding. But at the same time the roving must have the characteristic that after it is chopped the chopped strands do not stick to one another.

In producing rovings for weaving, the bundle of strands should be slightly stuck together, so that the roving enters the cloth manufacturing machinery in such a manner that the strands are stuck together, but the roving comes out in the cloth so that the strands are no longer stuck together. This facilitates impregnation of the cloth with liquid resins.

The rovings particularly useful in the above described methods of chopping and weaving are the dry rovings, and although these rovings have adequate choppability characteristics they do not possess all of the characteristics desired for good choppability. Roving of glass fibers or filaments in a dried condition are not adequately held together, where several rovings are combined into a single roving, and this is probably because of fracture of the size or bond during processing. When a dried, sized roving is chopped in a cutting device, only partial cutting takes place and usually a large number of filaments in the roving are not severed, because they readily separate when contacted by the cutter or severing device.

The prior art has confronted this problem by conditioning or treating the roving with moisture before or after the strands of the roving are wound in a package. This treating or conditioning of the roving prior to further processing involves contacting the roving with water or other vaporizable liquids so that the roving, while in wet condition, may be satifactorily severed into short lengths, or combined with other rovings to form a multiple assembly roving, or subjected to other processing steps. Conditioning the glass fiber strands with moisture or a vaporizable liquid can lead to problems of binder rub off during further processing. The binder rub off would cause additional tension and would cause problems in doffing the roving package from the winder.

Also some rovings for use in chopping have the strands of the roving stuck together in a manner which is referred to as taping. As described in "The Manufacturing Technology of Continuous Glass Fibers," by K. L. Loewenstein, Elsevier Scientific Publishing Company, New York, 1973 at page 260, taping is an important characteristic in order to present a consolidated bundle rather than individual strands while passing the roving through eyes and guides of the loom. For rovings constituting the warp in cloth this is of smaller importance; for rovings to be used in the weft, it is very important in order to avoid intolerable amounts of broken glass fibers being transferred to the atmosphere. Taping is carried out by heating the complete roving in an oven at about 100°-110° C. for four-six hours depending on the size of the roving. Taping or ribbonization, as it is sometimes called, is effected by the size or binder that is placed on the glass fibers during forming. This size or binder on the glass fiber strands that are made into roving provides some adhesion between the glass fiber strands in the roving after the roving is heated in the oven. Taping provides a degree of integrity between the strands in the roving but this degree of integrity could be improved upon to give better choppability and processability to the roving.

It is an object of this present invention to provide a method for producing bundles of strands having integrity between the strands to hold the strands together temporarily and to allow better processability by depressing fraying and snagging of the strands on processing machinery. It is an additional object of the present invention to provide a method for producing roving having integrity between the strands so that the strands are held together temporarily to increase the choppability of the roving, but once the roving is chopped the strands are no longer held together.

It is an additional object of the present invention to provide a method for producing roving which has improved integrity between the strands so that the strands are held together temporarily when the roving enters a cloth manufacturing or weaving machine but permits the strands to separate in the cloth or woven product exiting from the machine.

SUMMARY OF THE INVENTION

In accordance with the present invention a process is provided to give bundles of glass fiber strands a degree of integrity between the strands so that the strands are temporarily held together to facilitate further processing of the strand, but so that the glass fiber strands at some point during the further processing become unintegrated without an excessive effort in order to give the desired glass fiber product, where the strands are no longer or only loosely held together.

The process of the present invention embodies gathering together a plurality of glass fiber strands, and contacting the glass fiber strands with solid, fine, particlized, thermoplastic material in a forced air chamber so that the bundle of glass fiber strands has thermoplastic material in an amount up to about 0.5 percent by weight of the dried bundle, then heating the bundle of glass fiber strands after it has been removed from the forced air chamber to effect melting of the thermoplastic material to provide a temporary bond between the glass fiber strands. The heating can occur either before, during, or after the combined glass fiber strands are wound.

DETAILED DESCRIPTION OF THE INVENTION

Figure 1:
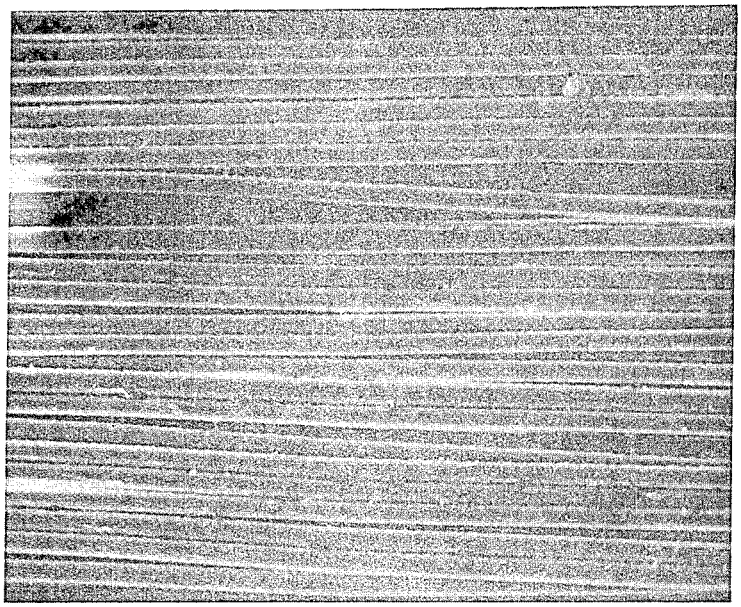
FIG. 1 is a photomicrograph of a bundle of glass fiber strands that is not treated by the process of the present invention.
Figure 2:
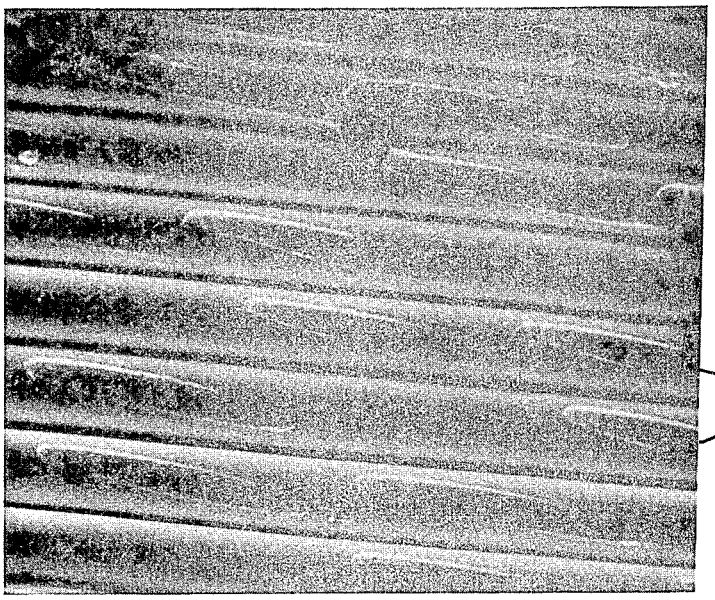
FIG. 2 is a photomicrograph of bundles of glass fiber strand that have been treated according to the process of the present invention as depicted in FIG. 3.

The photomicrographs of FIGS. 1 and 2 show the extent of the coverage of the thermoplastic material on the bundle of glass fiber strands. FIG. 1 shows the bundle of glass fiber strands without any thermoplastic material and it is noted that the strands in the bundle are linear and well defined. In FIG. 2 the coverage of thermoplastic material is seen as the material covering the linear glass fiber strand. This coverage is not a complete coating since a complete coating would hinder the processing of the bundle of glass fiber strands since the strands would not separate after chopping or weaving.

Figure 3:
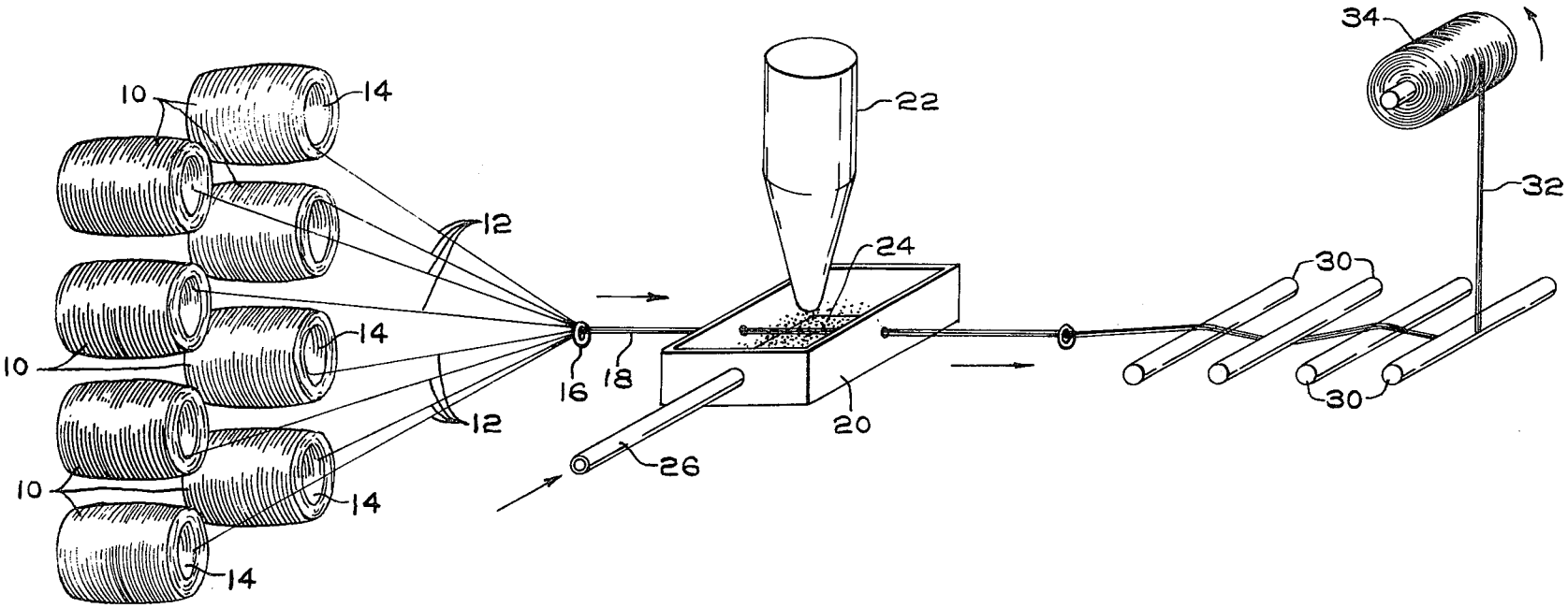
FIG. 3 is a schematic representation of the process of the present invention showing the contacting of a bundle of glass fibers strands with thermoplastic material.

In FIG. 3, a plurality of glass fiber forming packages is designated by reference numeral 10. Each forming package of glass fiber strand is produced in the conventional manner wherein streams of molten glass are pulled from orifices in a bushing containing molten glass and the molten streams cool to form glass filaments that are coated with a size composition to protect the filaments from abrading each other. Then the filaments are combined into strands and wound onto a winder that provides the pulling force for the molten glass streams. The plurality of glass fiber forming packages may be any number of forming packages depending on the number of strands desired in the bundle of strands to be produced. The bundle of glass fiber strands is usually referred to as a roving. The plurality of glass fiber strands designated by reference numeral 12 are drawn preferably from the central or inside region of the plurality of forming packages designated by reference numeral 14. The plurality of glass fiber strands, 12, are gathered together by a gathering eye, 16, which puts the plurality of glass fiber strands into a bundle of glass fiber strands reference numeral 18.

The bundle of glass fiber strands enters a chamber 20 at one side of the chamber, although the glass fiber strands may enter chamber 20 individually and then be brought together to form a bundle. The chamber can be any device or vessel known to those skilled in the art to be able to withstand the introduction of pressurized air or like gas and to be able to contain thermoplastic material in a fluidized state. Also introduced into chamber 20 from a vessel, 22, is the fine, solid, particulized thermoplastic material designated by reference number 24, where it fills the conical portion of vessel 22. The thermoplastic material is contained in vessel 22 which is a storage vessel to provide a sufficient quantity of thermoplastic material to the forced air chamber to permit continuous operation. From time to time the vessel 22 is refilled with thermoplastic material. The thermoplastic material enters from the conical portion 24 of vessel 22 into chamber 20 and is fluidized there by the entrance of pressurized air into chamber 20 through conduit 26. The pressure of the air entering vessel 20 by conduit 26 is sufficient to provide enough air in chamber 20 to fluidize the thermoplastic material. The pressurized air is supplied to conduit 26 from any conventional pressurized air source but any suitable gas may be used to fluidize the thermoplastic material, such gases include air, nitrogen, carbon dioxide, or inert gases such as helium and argon.

The principles of operation of the fluidization of the thermoplastic material by air or other gases are well-known to those skilled in the art. A current of air, or other gases, if a special atmosphere is required for either the thermoplastic material or the glass fiber strands, is passed into the chamber by a compressor or other supplier of gas under pressure. The air or other gases is advantageously dried by a suitable means and is distributed across the bed of particles of thermoplastic material merely by the surge of air or other gases entering the chamber from conduit 26. As the bundle of strands passes through the chamber 20 the particles of thermoplastic material become attached to the bundle by electrostatic forces and mechanical forces. The electrostatic charge present on the bundle of glass fiber strand attracts the particles of thermoplastic material. Also the particles of the powdered thermoplastic material impinge and become lodged between the strands that constitute the bundle of glass fiber strands. In this way the bundle becomes slightly covered with the thermoplastic material. The thermoplastic material becomes more firmly attached to the bundle when the bundle is heated to a temperature around or above the softening point of the thermoplastic material but below the melting point of the strand. Although it is not usually necessary to induce an added elastrostatic charge on the bundle of glass fiber strands to have a sufficient pick up of the solid particles of the thermoplastic material, an added electrostatic charge can be induced on the strand before it is carried through the chamber 20. Various ways of inducing such a charge can be utilized, such as, running the strands or bundle of strands through an air jet, running them between plates of different potentials, running the strands or bundle of strands over a dielectric surface, and other known methods of producing this result. Alternatively, the fluidized bed of solid particles of thermoplastic material can be modified by placing electrodes therein so that the particles of power pick up a charge which will cause them to be attracted to and to adhere to the oppositely charged body of strand.

The bundle of glass fiber strands entering the forced air chamber contains a certain amount of static electricity picked up when the individual strands are drawn from the glass fiber strand forming package. This static electricity serves as one of the forces by which the bundle picks up the thermoplastic material as the bundle moves through the fluidized bed of thermoplastic material. The amount of pick up of the thermoplastic material is regulated by the speed with which the bundle of glass fiber strands moves through the forced air chamber, and by the amount of charge on the glass fiber strand, and by the density of the fluidized bed of thermoplastic material. These variables are regulated so that the amount of thermoplastic material picked up by the bundle of glass fiber strands is an amount up to about 0.5 weight precent based on the weight of the dried bundle of glass fiber strands. With this small amount of thermoplastic material being added to the bundle of glass fiber strands, the static electrical charge on the bundle resulting from the removal of the strands from the forming package is sufficient to give this small amount of pick up.

The bundle of glass fiber strands drawn through chamber 20 is drawn in such a manner to allow the thermoplastic material to be placed on the bundle in an amount up to about 0.5 percent by weight of the bundle in a dried condition. The bundle of glass fiber strands is then withdrawn from chamber 20 by the opening 28 and the bundle is conveyed to tensioning bars 30. The tensioning bars may be modified to allow a heat source to heat the tensioning bars so the bundle of strand passing over the bars can be heated. Also different heating apparatus may be positioned before or after the tensioning bars to heat the bundle of glass fiber strands before it is wound. The bundle of glass fiber strands covered with thermoplastic material in an amount of up to about 0.5 percent by weight of the bundle designated by reference number 32 is then wound onto the mandrel of a conventional roving winding machine to produce a roving package designated by reference numeral 34.

As mentioned, the heating of the bundle of glass fiber strands having the thermoplastic material may take place before or during winding, but it is preferred to heat the bundle of glass fiber strands after the bundle is wound to produce a roving package. The heating reactivates the thermoplastic material so the thermoplastic material at differing locations on and in the bundle flows to contact several glass fiber strands, for example as shown in FIG. 3. The heating before winding can be accomplished by dielectric heating, infrared heating and the like. Heating the wound roving package or a plurality of packages can be accomplished by dielectric, infrared, or forced draft heating. The preferred method is forced draft heating in an oven for about 1 to about 12 hours at a temperature around or slightly greater than the softening point of the thermoplastic material.

The thermoplastic material that can be introduced into the forced air chamber to be fluidized therein and to contact the bundle of glass fiber strands must be a material which when heated to above its softening point will form a homogeneous mass. The thermoplastic material that is preferred for use is a powdered, thermoplastic, polyester resin; for example, Atlac bisphenol A type of polyester resin available from Atlas Chemical Industries, Inc. The particle size of the thermoplastic material is generally an average particle size of less than 1500 microns and preferably in the range of about 100 to 500 microns average particle size. Examples of suitable thermoplastic material which may be used include polymers and copolymers of alphaolefins such as polyethylene, and polybutene and ethyl/vinyl acetate copolymers; polymers and copolymers of vinylchloride, vinyl acetate, vinylbutyral, styrene and substituted styrene such as alphamethyl styrene, acrylonitrile, methyl methacrylate, and vinylidene chloride; and condensation polymers such as linear polyesters such as polyethylene terephthalate; polyamides; polycarbonates; and thermoplastic polymers and copolymers of formaldehyde; and thermoplastic linear polyurethanes and thermoplastic derivatives of cellulose. It is also within the scope of the present invention to use blends of these thermoplastic materials. Other materials which can be added to the powdered thermoplastic material include stabilizers, lubricants, plasticizer, dyes impact modifiers processing aids, anti-static agents, a catalyst to aid in the cure of the thermoplastic material, fuzz reducing agents and fillers.

The amount of pickup of thermoplastic material on the bundle of glass fiber strands on a dried basis can be measured by any conventional measuring technique for measuring the amount of material on glass fiber strands, such as loss on ignition (LOI) where the glass fiber containing the material is weighed then ignited and then weighed after ignition. This amount of pick up by the bundles of glass fiber strand of up to about 0.5 weight percent based on the dried or heated roving or bundle is a critical amount. The bundle of glass fiber strands must have sufficient integrity so that the strands are bonded together to cause ribbonization of the bundle of glass fiber strands to allow good processing during use, but the strands should not be stuck together to such an extent that after processing, whether it be chopping or weaving, the chopped or woven glass fiber strands still stick together. Therefore this critical amount of thermoplastic material of up to 0.5 weight percent gives the bundle of glass fiber strands sufficient integrity without detrimentally affecting the processed or manufactured product of the bundle of glass fiber strands, i.e., chopped strands or woven strands.

To summarize, the preferred embodiment of the present invention involves gathering a plurality of glass fiber strands to form a bundle of strands. The bundle of strands is then conveyed to a chamber where polyester resin like Atlas bisphenol A resin is introduced and where pressurized air is introduced. The pressurized air causes the fluidization of the polyester resin. As the bundle of glass fiber strands move through the chamber, the bundle picks up polyester resin by electrostatic and mechanical forces. The bundle is moved through the chamber by a winder pulling the bundle at such a speed that the pick up of polyester is an amount up to 0.5 percent by weight of the dried bundle. The winder pulls the bundle from the chamber across tensioning bars and into a roving package on the winder mandrel.

A plurality of roving packages of glass fiber strands each containing the critical amount of polyester resin is conveyed to a forced draft oven operating at a temperature of around 250° to around 400° F. (around 120° C. to around 205° C.) sufficient to soften the polyester resin. The temperature of operation of the oven area will depend upon the softening point of the particular polyester resin used. The dried bundle of glass fiber strand containing the critical amount of the polyester resin is removed from the oven and is ready for use in chopping or weaving machinery. With the use of this process larger roving packages can be wound on the roving machinery.

By following the process described above a bundle of glass fiber strand i.e., a roving, can be produced which has improved integrity, but does not have glass fiber strands that stick together so much as to detrimentally affect the processing of the bundle of glass fiber strands. This process is therefore beneficial in manufacturing roving for chopping and for weaving. The roving will have improved choppabilities and the bundles of glass fiber strands will be held together when chopped to enable better cutting of the bundle, but once the bundle is chopped the strands will not coalesce and will separate into individual chopped strands. In weaving the bundles of glass fiber, strands will coalesce to give improved performance during fabrication of cloth, but once the cloth is formed the strands will not coalesce and will be individual strands.

I claim:

1. A method of providing a small degree of integrity to a plurality of glass fiber strands, wherein each strand is composed of a plurality of glass fibers coated with a sizing composition to protect the fibers from interfiber abrasion, and to provide integrity between the fibers making up the strands, so that the individual glass fiber strands are slightly held together but have reduced coalescence after further processing operations, thereby eliminating the need for a working operation to separate the strands from the plurality of strands, comprising:

(a) removing a plurality of strands of glass fibers from their individual forming packages on which they are collected during forming of the glass fiber strands from molten glass streams flowing from small openings in a bushing;

(b) contacting the plurality of glass fiber strands with solid, fine, particulized, thermoplastic material in a forced gas chamber;

(c) gathering together the plurality of glass fiber strands into a bundle while the glass fiber strands are contacting the thermoplastic material, whereby the contacting and gathering allow the glass fiber strands to have thermoplastic material on one or more of the strands in an amount up to about 0.5 percent by weight of the dried combined strands, wherein the pickup is the result of electrostatic charges on the plurality of glass fiber strands resulting from the removal of the strands from the forming packages;

(d) heating the bundle of the plurality of glass fiber strands containing the thermoplastic material to effect softening of the thermoplastic material to provide a temporary bond between the strands so that a bundle of glass fiber strands is produced wherein the strands are slightly held together.

2. Method according to claim 1 wherein the thermoplastic material is a powdered thermoplastic polyester resin.

3. Method according to claim 1 wherein the heated plurality of glass fiber strands in the form of a bundle are wound to produce a roving package.

4. Method according to claim 1 further comprising: winding the bundle of plurality of glass fiber strands contacted with the thermoplastic material before the bundle is heated.

5. Method according to claim 4 wherein a plurality of wound bundles of plurality of glass fiber strands are heated.

6. Method according to claim 1 wherein the heating is by dielectric heating.

7. Method according to claim 1 wherein the heating is by infrared heating.

8. Method according to claim 1 wherein the heating is by forced draft.

9. A method of producing roving having a slight degree of integrity between the glass fiber strands, wherein each strand is composed of a plurality of glass fibers coated with a sizing composition to protect the fibers from interfilament abrasion, and to provide integrity between the filaments making up the strand so that the strands are held together during subsequent processing, but so that the strands are allowed to separate after chopping or weaving, comprising:

(a) gathering together a plurality of glass fiber strands from forming packages on which the glass fiber strands are collected during their formation from molten glass streams flowing from small openings in a bushing into a bundle;

(b) contacting the bundle of glass fiber strands with solid, fine, particlized thermoplastic material in a forced air chamber so that the glass fiber strands have thermoplastic material on one or more of the strands in an amount up to about 0.5 percent by weight of the dried bundle, (c) winding the bundle of glass fiber strands containing the thermoplastic material into a roving package, and (d) heating a plurality of roving packages of glass fiber strands containing the thermoplastic material at a temperature around the softening point of the thermoplastic material to produce the roving with improved integrity.

10. Method according to claim 9 wherein the thermoplastic material is a polyester resin.

11. Method according to claim 1 wherein an additional electrostatic charge in addition to the electrostatic charge on the glass fiber strands due to the removal of the strands from the forming package before the strands are contacted with the thermoplastic material is induced on the glass fiber strands before said strands enter said gas chamber.

12. A bundle of glass fiber strands produced by the method of claim 1.

* * * * *